United States Patent [19]

Baumeister

[11] 4,089,562

[45] May 16, 1978

[54] CUTTER FOR ASPHALT PAVING

[76] Inventor: Frederick F. Baumeister, 11 Sterner Ave., Broomall, Pa. 19008

[21] Appl. No.: 791,543

[22] Filed: Apr. 27, 1977

[51] Int. Cl.[2] ..... E21C 37/26; E01C 23/09

[52] U.S. Cl. ..... 299/94; 30/168; 125/36

[58] Field of Search ..... 299/94, 26, 69, 37; 175/414; 30/168, 277; 125/36, 40, 41

[56] References Cited

U.S. PATENT DOCUMENTS

| | | | |
|---|---|---|---|
| 1,452,037 | 4/1923 | Gleasner | 299/69 |
| 1,891,222 | 12/1932 | Cornett | 299/94 |
| 2,302,069 | 11/1942 | Stephens | 299/94 |
| 2,900,178 | 8/1959 | Harrison et al. | 299/94 |
| 3,258,295 | 6/1966 | Ives et al. | 299/94 |

*Primary Examiner*—Ernest R. Purser

*Assistant Examiner*—Nick A. Nichols, Jr.

*Attorney, Agent, or Firm*—Paul and Paul

[57] ABSTRACT

An asphalt-paving cutter tool, adapted to be driven by a power-operated hammer mechanism, has an upper shank adapted to be received and held in the socket of the hammer mechanism, and a wide lower cutter portion terminating at the lower end in a chisel-like cutting edge. Intermediate the upper shank and the lower cutter portion is a wedging-and-reaction portion having divergently-upward sidewalls inclined at an angle of the order of 15°-35° relative to the vertical. This portion has two functions. It develops a wedging force to widen the cut, and it develops a reaction force in the blade-lifting direction. These two forces facilitate removal of the cutting tool from the asphalt paving after the cut has been made.

4 Claims, 5 Drawing Figures

CUTTER FOR ASPHALT PAVING

BACKGROUND OF THE INVENTION

It is known in the prior art to provide a broad blade cutter tool having a shank adapted for insertion into the socket or clutch of a power-driven hammer mechanism, such as a air-operated hammer, for cutting asphalt pavement.

It is frequently difficult, however, particularly in the warmer weather when the asphalt paving tends to be soft and tacky, for the operator to pull up the cutter tool after the cutting stroke has been completed. Frequently, the operator must push and pull, back and forth, while at the same time pulling upwardly on the tool in an effort to lift the tool and free it for the next cut. In his efforts to lift the tool, and due to position of the tool relative to his body, the operator not infrequently overstrains himself and suffers injury to his back, or to his groin, or elsewhere.

SUMMARY OF THE INVENTION

A principal object of the present invention is to provide a cutter tool for asphalt paving and the like, adapted for use in a power-driven hammer mechanism and characterized by a capability or being much more easily lifted and removed from the asphalt paving after the cutting stroke has been completed.

Another object is to provide a tool, of the type and having the characteristic described above, having a portion adapted to develop both a wedging force and a reaction force in a blade-lifting direction, thereby to facilitate removal of the tool upon completion of the cutting stroke.

DETAILED DESCRIPTION OF THE PREFERRED EMBODIMENTS

Figure 2:
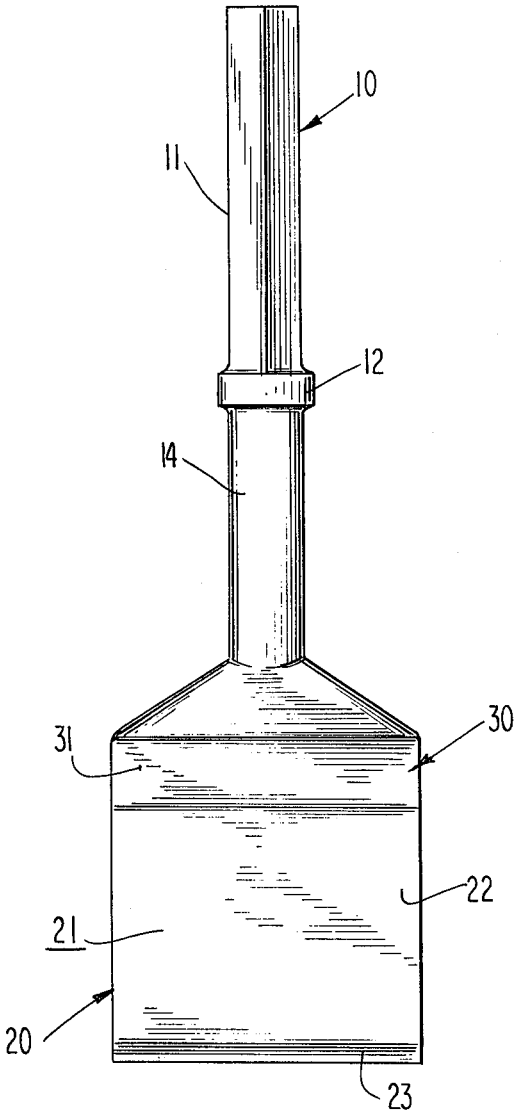
FIG. 2 is a side elevational view of the tool of FIG. 1.

Referring now to the drawings, the tool according to the present invention has three major portions, namely, an upper shank portion 10, a lower cutter portion 20 and, located intermediate the shank and cutter portions, a wedging-and-reaction portion 30.

Shank portion 10 has an upper portion 11 preferably of hexagonal cross section and adapted to fit into the socket or clutch portion of a known type of pavement breaker, such as an air hammer. The hex shank portion 11 terminates at its lower end in a collar 12 which functions to lock the tool into the socket or clutch of the pavement breaker. Below collar 12, is a portion 14, generally of circular cross section. Portion 14 merges into the wedging-and-reaction portion 30.

Figure 1:
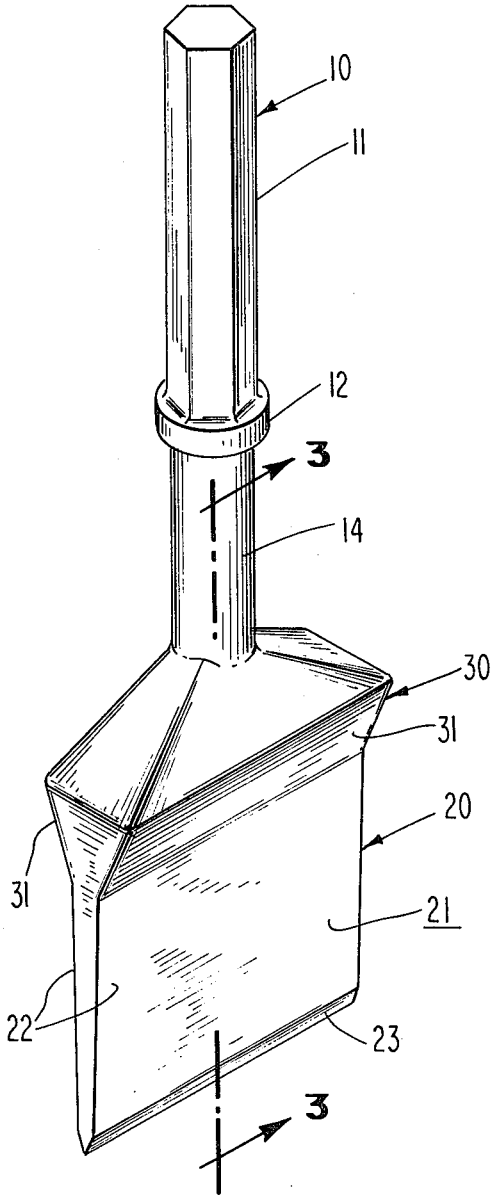
FIG. 1 is a perspective view of a cutting tool according to the present invention.
Figure 4:
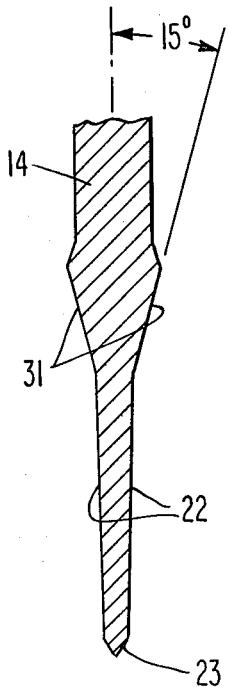
FIGS. 3–5 are views, in section, showing different angles of inclination of the sidewalls of the wedge-and-reaction portion of the tool.
Figure 3:
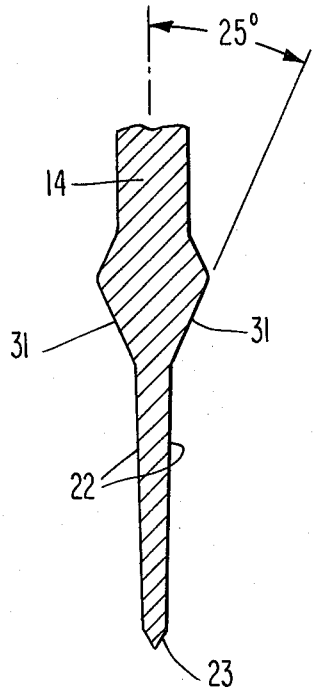
Figure 5:
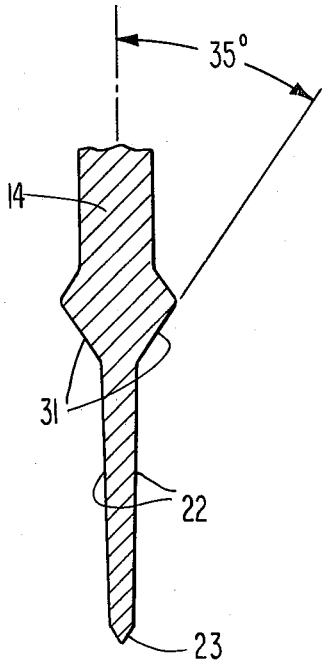

Below the wedging-and-reaction portion 30 is the cutter portion 20 which comprises a blade 21 having a pair of opposing sidewalls 22 which are slightly divergent upwardly, as seen best in FIG. 1. The blade 21 terminates at its lower end in a chisel-like cutting edge 23.

The wedging-and-reaction portion 30, located intermediate the uppe shank portion 10 and the lower cutter portion 20, is characterized by a pair of opposing sidewalls 31 which are divergent in the upwardly direction at an angle in the range of 15°–35° relative to the vertical. The preferred angle is 25°.

In the absence of the wedging-and-reaction portion 30, after the operator has driven the cutter blade portion 20 into the asphalt pavement to the full depth of cutter blade 21, the operator frequently has great difficulty in pulling up and removing the blade from the cut asphalt. This is particularly true in the warmer weather. And, not infrequently, in trying to lift the cutting blade from the asphalt cut, the operator over-strains and injures himself.

The danger of the operator over-straining and suffering injury is greatly reduced when the tool of the present invention is used. After the cutter blade has been driven to the full depth of the blade 21, the operator does not discontinue cutting, as he did with the prior art tool. Rather, he continues to operate the hammer to drive the cutting blade in a downward direction. This brings the divergent sidewall surfaces 31 into driving contact with the upper surface of the flexible asphalt paving and has two benefical effects. One is to wedge apart the walls of the cut, thereby removing the asphalt material from the opposing surfaces of the blade 21. This tends to loosen the blade from the asphalt. A second and most important effect is the reaction effect. This is the effect which results when the widely-divergent surfaces 31 of the portion 30 are driven downwardly into contact with the upper surface of the flexible asphalt paving on both sides of the cut. There is no cutting action and the reaction effect is to tend to lift the blade 21 upwardly, away from the asphalt surface. The total result of the two effects, which have just been described is to make it very much easier for the operator to pull up the blade, out of the cut, without undue strain and without injury to himself.

I have discovered that the optimum angle of divergence for the opposing surfaces 31 is 25° from the vertical. Some departure from this optimum angle is permissible. However, as the angle is decreased, both the wedging-apart effect and the reaction effect are decreased. As the angle is increased from optimum, reaction effect tends to increase but this is more than offset by a decrease in the wedging-apart effect.

I do not wish to be limited to a particular set of dimensions. However, I may say that a tool constructed in accordance with the present invention, has the following dimensions:

Hex shank 11 has a maximum cross dimension of 1 ⅛" and a length of 6". Collar 12 has a diameter of 1¾" and a thickness of ½". Shank portion 14 has a diameter of 1¼" and a length of 4¼". Wedge-and-reaction portion 30 has an overall length length of 2¼" of which ¾" is the length from shank portion 14 to the widest portion of the wedge-and-reaction portion 30, and 1½" is the length from the widest portion of 30 to the upper limit of blade 21. Blade 21 has a width of 5" and a height of 4½". The tool is formed in one piece from hardened steel.

What is claimed is:

1. A cutter tool for asphalt paving and the like, said tool comprising:

a. an upper shank adapted to be received within the socket of a power-driven hammer mechanism;

b. a lower blade characterized by a cutting edge at its lower end, said lower blade further comprising a first pair of substantially flat opposing upwardly divergent sidewalls inclined at an angle less that 10° relative to the vertical; and c. a means for facilitating the removal of said tool from said asphalt, said removal comprising a wedging-and-reaction portion located intermediate said blade and said shank, said wedging-and-reaction portion characterized by a second pair of substantially flat upwardly divergent sidewalls inclined at an angle in the range of 15°–35° relative to the vertical, wherein the surfaces of said first pair of sidewalls intersect respectively with the surfaces of said second pair of sidewalls along discrete lines, and wherein said second pair of sidewalls wedges said cut asphalt apart and develops a reaction force in a blade-lifting direction in response to downward force applied to said blade when said blade is driven in a downward direction beyond the upper limit of said blade.

2. A tool according to claim 1 wherein the angle of said second pair of sidewalls of said wedging-and-reaction portion is in the range of 20°–30°.

3. A tool according to claim 2 wherein:

a. said shank is of hexagonal cross-section; and b. said shank includes a collar for locking said shank into said socket.

4. A tool according to claim 3 wherein the angle of said second pair of sidewalls of said wedging-and-reaction portion is about 25°.

* * * * *